US005896607A

United States Patent [19]

Hagen

[11] Patent Number: 5,896,607

[45] Date of Patent: Apr. 27, 1999

[54] MULTI PURPOSE HINGE PIN REMOVER

[76] Inventor: Glen Hagen, 16135 Hwy. 9, C7, Breckenridge, Colo. 80424

[21] Appl. No.: 08/937,135

[22] Filed: Sep. 24, 1997

Related U.S. Application Data

[60] Provisional application No. 60/026,609, Sep. 24, 1996.

[51] Int. Cl.[6] ..... B66F 15/00

[52] U.S. Cl. ..... 7/166; 81/20; 7/144

[58] Field of Search ..... 7/143, 144, 146, 7/147, 166; 81/20, 45

[56] References Cited

U.S. PATENT DOCUMENTS

| | | |
|---|---|---|
| 2,457,231 | 12/1948 | Henderson . |
| 3,680,834 | 8/1972 | Holloway . |
| 3,769,644 | 11/1973 | Case . |
| 3,813,081 | 5/1974 | Alger . |
| 4,042,210 | 8/1977 | Feldmann . |
| 4,182,390 | 1/1980 | Renner . |
| 4,188,701 | 2/1980 | Ludwig . |
| 4,464,819 | 8/1984 | Steck et al. . |
| 4,844,416 | 7/1989 | Hand . |
| 5,054,180 | 10/1991 | Combs . |
| 5,184,385 | 2/1993 | Valesh . |
| 5,207,126 | 5/1993 | Schaben . |
| 5,322,264 | 6/1994 | Giambro . |
| 5,438,743 | 8/1995 | Simington et al. . |
| 5,495,651 | 3/1996 | Tsuha . |

FOREIGN PATENT DOCUMENTS

| | | | |
|---|---|---|---|
| 295588 | 7/1963 | Netherlands | 7/144 |

*Primary Examiner*—James G. Smith
*Attorney, Agent, or Firm*—Rick Martin

[57] ABSTRACT

A multi purpose hinge pin remover can also be used as a pry bar. The preferred embodiment has a hand guard, a hammer head and two additional working surfaces for use in repairing shingles.

9 Claims, 1 Drawing Sheet

MULTI PURPOSE HINGE PIN REMOVER

CROSS-REFERENCE TO RELATED APPLICATION

This application is a non-provisional application claiming the benefits of provisional application No. 60/026,609 Sep. 24, 1996.

FIELD OF INVENTION

The present invention relates to a hinge bolt remover especially suited to remove car door hinge bolts.

BACKGROUND OF THE INVENTION

The closest known prior art is U.S. Pat. No. 5,054,180 (1991) to Combs. Combs addresses the problem of removing a headed hinge pin from a car door. His tool gets the job done while offering some protection to the worker who is hitting the tool with a hammer. The present invention offers further protection for the worker's hand by providing a hand guard. Additionally the same tool can be used as a hammer, a nail puller, a pry bar and a roofer's shingle remover.

Related art is noted below.

SUMMARY OF REFERENCES FOUND

U.S. Pat. No. 2,457,231 (1948) to Henderson discloses a wrecking bar having a crowbar end and a handle capable of being used to remove hinge pins. A second end has two claws attached thereto.

U.S. Pat. No. 3,680,834 (1972) to Holloway discloses a double-ended pry bar.

U.S. Pat. No. 3,769,644 (1973) to Case discloses a roofer's hammer and claw and method to repair a roof.

U.S. Pat. No. 3,813,081 (1974) to Alger discloses an angled crowbar used to pull nails from inaccessible locations.

U.S. Pat. No. 4,042,210 (1977) to Feldman discloses a leverage pry bar having a moveable fulcrum.

U.S. Pat. No. 4,182,390 (1980) to Renner discloses a roof shingle remover pry bar.

U.S. Pat. No. 4,188,701 (1980) to Ludwig discloses a hinge pin remover having a handle perpendicular to the hinge bolt claw making it useful only on easily accessible hinges.

U.S. Pat. No. 4,464,819 (1984) to Steck et al. discloses an automobile hinge pin remover having a Z-shaped pry bar.

U.S. Pat. No. 4,844,416 (1989) to Hand discloses a crowbar having an offset mid portion.

U.S. Pat. No. 5,054,180 (1991) to Combs discloses a hinge pin tool for automobiles having a claw and a driving portion to receive hammer blows parallel to the location of the hinge bolt.

U.S. Pat. No. 5,184,385 (1993) to Valesh discloses a retainer pin remover.

U.S. Pat. No. 5,207,126 (1993) to Schaben discloses a roof shake removal pry bar.

U.S. Pat. No. 5,322,264 (1994) to Giambro discloses a nail remover having an offset handle parallel to the claw.

U.S. Pat. No. 5,438,743 (1995) to Simington et al. discloses a hinge pin removal tool for automobiles having an offset handle.

U.S. Pat. No. 5,495,651 (1996) to Tsuha discloses a hose remover.

SUMMARY OF THE INVENTION

The primary aspect of the present invention is to provide a hinge pin remover tool that offers a hand guard to protect the worker's hand.

Another aspect of the present invention is to provide the tool with a hammer, a pry bar and a nail remover.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
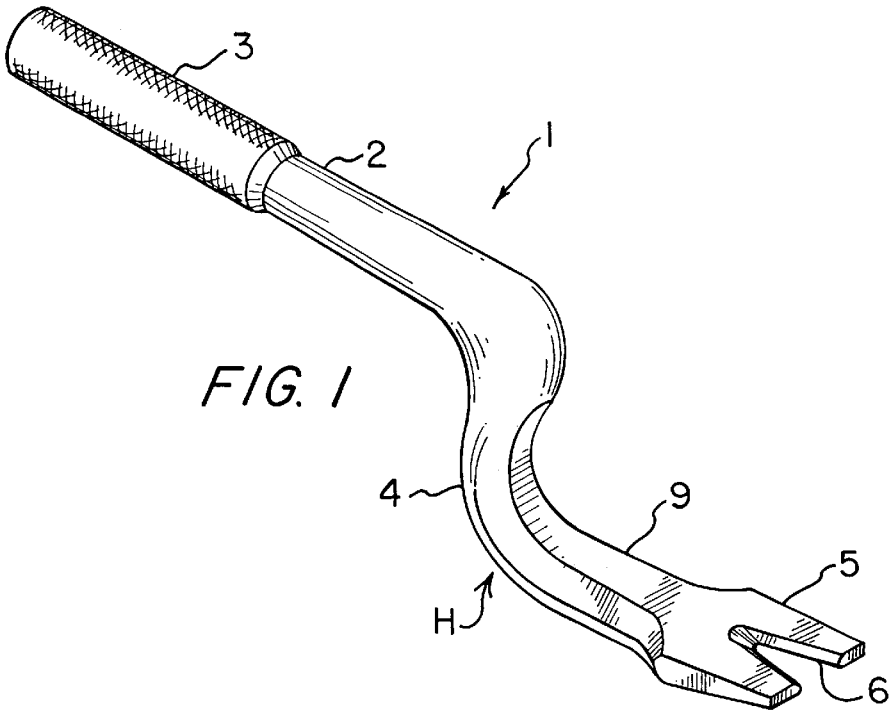
FIG. 1 is a top perspective view of a first embodiment of a hinge pin remover.

Referring first to FIG. 1 a hinge pin remover 1 has a central shank 2, a distal handle 3 and a proximal working notch 6. The proximal working notch 6 is cut into a pry bar end 9 having a transition shaft 4 connecting it to the central shank 2. An offset of d1 exists between central shank 2 and pry bar end 9 which are parallel. The handle 3 is knurled.

Figure 2:
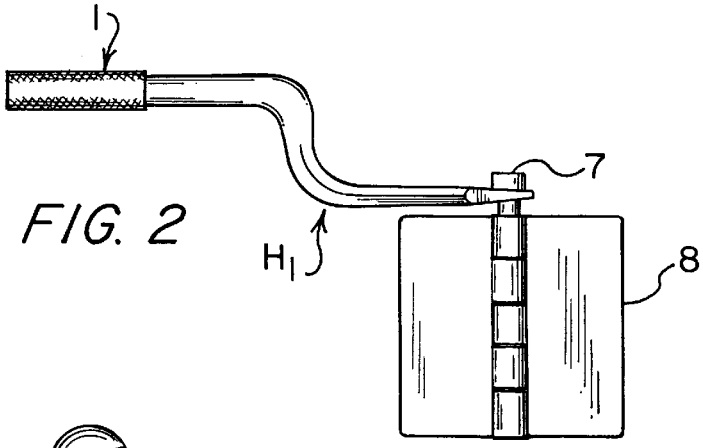
FIG. 2 is a top perspective view of the tool of FIG. 1 removing a hinge pin.

A hammer tap at H3 may be needed to engage the hinge pin head as shown in FIG. 2. Once the working notch 6 is engaged a hammer blow at H1 lifts the hinge pin 7 from the hinge 8. The working notch 6 is also useful to pop out roof liner pop rivets, door liner pop rivets and the like.

Figure 3:
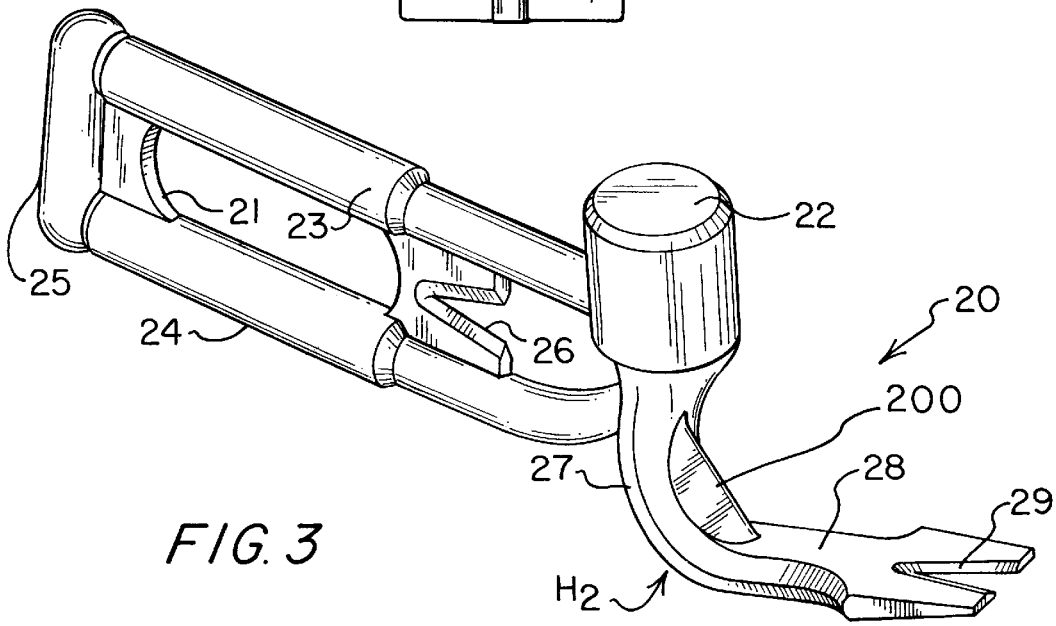
FIG. 3. is a top perspective view of a second and preferred embodiment of a hinge pin remover.

Referring next to FIG. 3 a hinge pin remover 20 has a central shank 30, a distal handle 23, and a proximal working notch 29. The proximal working notch 29 is cut into a pry bar end 28 having a transition shaft 27 connecting it to the central shank 30. An offset of d2 exists between central shank 30 and pry bar end 28 which are parallel. The handle 23 is knurled.

A hammer tap at H4 may be needed to engage the hinge pin head. Once the working notch 29 is engaged a hammer blow at H2 lifts the hinge pin from the hinge in a like fashion as shown in FIG. 2. The hand guard 24 protects the worker's hand during use. The offset d2 enables the hand guard 24 to not interfere with the work in close quarters. Nominally d1=d2=two inches.

Further uses of the hinge pin remover 20 include using the hammer 22. Hitting the brace 25 can drive the working notch 29 or the working pry ridge 21 or the working notch 26. A roofer can use all the above noted working surfaces to remove shingles and nails and drive in nails into new shingles. Cutting edge 200 can be used as a tarpaper splitter by thrusting it across the tarpaper.

Although the present invention has been described with reference to preferred embodiments, numerous modifications and variations can be made and still the result will come within the scope of the invention. No limitation with respect to the specific embodiments disclosed herein is intended or should be inferred.

GLOSSARY

1. HINGE PIN REMOVER
2. CENTRAL SHANK
3. DISTAL HANDLE
4. TRANSITION SHAFT
6. PROXIMAL WORKING NOTCH
7. HINGE PIN
8. HINGE
9. PRY BAR END
20. HINGE PIN REMOVER
21. WORKING PRY RIDGE
22. HAMMER
23. DISTAL HANDLE
24. HAND GUARD
25. BRACE
26. WORKING NOTCH
27. TRANSITION SHAFT
28. PRY BAR END
29. PROXIMAL WORKING NOTCH
30. CENTRAL SHANK
200. CUTTING EDGE

I claim:

1. A multi-purpose tool comprising:

a brace;

a first rigid member extending perpendicularly from said brace functioning as a handle;

a second rigid member extending perpendicularly from said brace and parallel to said first rigid member functioning as a hand guard;

a prying member disposed between said first and second rigid members;

a nail puller disposed between said first and second rigid members;

a blunt member formed from said first rigid member;

a curved member formed from said first and second rigid members;

a cutter having a cutting edge formed from said curved member;

a third rigid member formed from said curved member; and a hinge pin puller formed from said third rigid member.

2. The tool of claim 1, wherein said first rigid member further comprises a knurled handle.

3. The tool of claim 1, wherein said prying member further comprises a working pry ridge.

4. The tool of claim 1, wherein said nail puller further comprises a working notch.

5. The tool of claim 1, wherein said blunt member further comprises a hammer head.

6. The tool of claim 1, wherein said curved member further comprises a transition shaft.

7. The tool of claim 1, wherein said third rigid member further comprises a pry bar end disposed parallel to said first and second rigid members.

8. The tool of claim 1, wherein said hinge pin puller further comprises a working notch.

9. A multi-purpose tool comprising:

a brace;

a handle extending perpendicularly from said brace;

a hand guard extending perpendicularly from said brace and disposed parallel with said handle;

a working pry ridge disposed between said handle and said hand guard;

a working notch disposed between said handle and said hand guard;

a hammer head formed from said handle;

a transition shaft formed from said handle and said hand guard;

a cutting edge formed from said transition shaft;

a pry bar end formed from said transition shaft and parallely disposed to said handle and said hand guard; and a working notch formed from said pry bar end.

* * * * *